United States Patent [19]

Kennedy

[11] Patent Number: 5,042,183

[45] Date of Patent: Aug. 27, 1991

[54] COMPOSITE WIRE STAKE APPARATUS FOR SUPPORTING CORRUGATED SIGNS

[76] Inventor: Omar B. Kennedy, P.O. Box O, Roseland, La. 70456

[21] Appl. No.: 560,132

[22] Filed: Jul. 31, 1990

[51] Int. Cl.[5] ..... G09F 15/00

[52] U.S. Cl. ..... 40/607; 248/156

[58] Field of Search ..... 40/606, 607, 645, 124.1, 40/538, 610; 248/156, 175, 530, 532, 533; 297/444, 297

[56] References Cited

U.S. PATENT DOCUMENTS

| | | | |
|---|---|---|---|
| 2,602,250 | 7/1952 | Raising | 40/538 X |
| 2,819,547 | 1/1958 | Clements Jr. | 40/610 X |
| 2,955,646 | 10/1960 | Briggs | 297/444 |
| 2,976,000 | 3/1961 | Gunderson | 248/156 |
| 3,469,335 | 9/1969 | Leigh | 40/124.1 |
| 4,658,527 | 4/1987 | Pingel | 40/606 |
| 4,894,937 | 1/1990 | Davis | 40/606 |

*Primary Examiner*—Kenneth J. Dorner

*Assistant Examiner*—J. Bonifanti

*Attorney, Agent, or Firm*—Pravel, Gambrell, Hewitt, Kimball & Krieger

[57] ABSTRACT

A composite support stake for holding a corrugated sign in an upright position, includes a pair of spaced apart, longitudinally extending wire post members of a first diameter and a transverse cross beam connecting the lower end portions of the pair of post members to define a step for driving the posts into the underlying soil foundation. A pair of elongated wire pins connect respectively to the pair of post members and the outer surface thereof so that the top of each post acts as a stop for defining the penetration of the pins into the corrugated portion of the sign. The posts can be much greater in diameter than the pins, preferably having a diameter of at least twice the diameter of the pins. The wire posts can thus be made much heavier as they do not have to fit into the corrugated sign, so that the posts carry the load of a users foot in penetrating the soil.

8 Claims, 1 Drawing Sheet

COMPOSITE WIRE STAKE APPARATUS FOR SUPPORTING CORRUGATED SIGNS

BACKGROUND OF THE INVENTION

1. Field of the Invention

The present invention relates to support stakes for holding corrugated signs and more particularly relates to an improved support stake of composite construction that includes a pair of spaced apart heavier, larger diameter posts that support at their upper end portion a pair of thinner wire pins that are used to penetrate the corrugated sign.

2. General Background

Several types of constructions have been used for holding common display signs which are used frequently in the real estate industry for example in advertising the sale of homes. These signs can be held with a wooden stake or holder having holes or slots therethrough for the attachment of screws and bolts. However, the wooden signs suffer in that they require a mallet or hammer in order to drive the sign into the soil. This can be time consuming, and sometimes impossible if the soil is dry and very hard. Further, it requires that the user carry around a heavy mallet or hammer in his or her possession in order to install the sign. The hammer can damage wooden stakes, as they tend to crack after receiving repeated blows.

One particular type of sign has been patented which uses very thin wire members of generally uniform construction (U.S. Pat. No. 4,894,937). Two longitudinally extending post members of the thin wire provide upper ends for supporting the sign and lower ends for driving into the soil. A lower most transverse member is used for the placement of the user's foot thereon when driving the sign into the soil and an upper most transverse cross member defines a stop for limiting penetration of the longitudinal wires into the sign.

The problem with wire signs of generally uniform thin wire material is that the signs are necessarily very flimsy because the wire is of a small diameter sized to fit the spaces or corrugations of the sign itself. Thus, the wire signs which are commercially available are generally very flimsy and prone to bending, breakage and the like. Further, because the wires are very light weight and flimsy they frequently bend when driving into very hard soil. In some instances, where the soil is very hard, not enough energy can be transferred through the foot of the user to the sign in order to drive it into the soil without breaking the sign.

SUMMARY OF THE PRESENT INVENTION

The present invention provides an improved support stake apparatus for holding a corrugated sign in an upright position. The apparatus includes a pair of spaced apart longitudinally extending wire support post members of a first larger diameter.

A transverse cross beam connects the lower end portions of the pair of post members to define a step for driving the posts into the underlying soil foundation.

A pair of elongated wire pins are connected respectively to the pair of post members and to the outer surface thereof so that the top of each of the posts acts as a stop for defining the penetration of the pins into the corrugated portion of the sign. The posts preferably have a diameter of at least twice the diameter of the pins. The posts can be made very heavy in order to maximize the load that can be transferred to the entire apparatus during driving of the sign hold into the underlying earth and without damage thereto.

In the preferred embodiment, the pins are of an unequal length so that one pin at a time can be inserted into the sign at the corrugations.

In the preferred embodiment, the pins are preferably curved at their mid-portion for adding frictional resistance between the pins and the corrugated portions of the sign.

In the preferred embodiment, the pins are of a length of about one half to one third ($\frac{1}{2}$–$\frac{1}{3}$) the length of the posts. In the preferred embodiment, the bottom end portion of each pin overlaps the upper end portion of each post. In the preferred embodiment, a welded connection interfaces the upper end portion of each of the posts and the lower end portion of each of the pins.

In the preferred embodiment, the transverse cross beam member is of a diameter that approaches the diameter of the posts.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

FIGS. 1–6 disclose the preferred embodiment of the apparatus of the present designated generally by the numeral 10.

Figure 1:
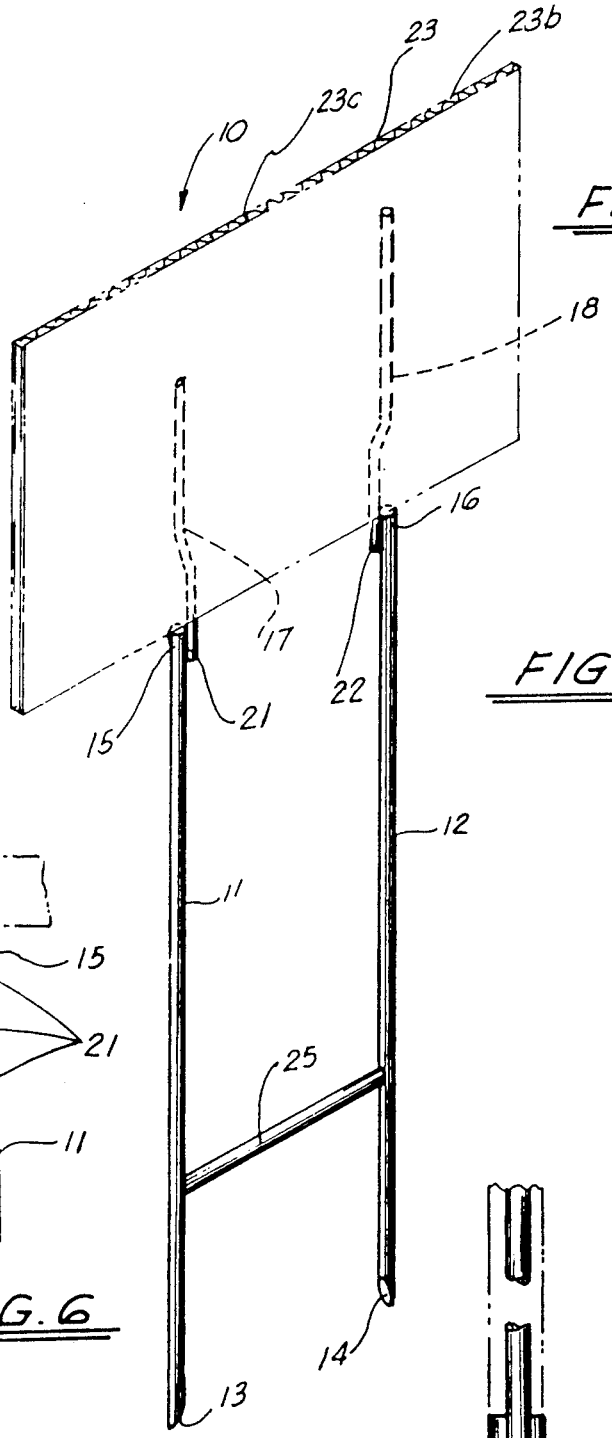
FIG. 1 is a perspective view of the preferred embodiment of the apparatus of the present invention.
Figure 6:
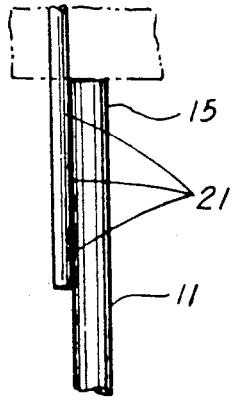
FIG. 6 is yet another fragmentary view of the preferred embodiment of the apparatus of the present invention.
Figure 5:
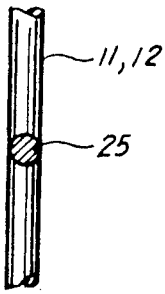
FIG. 5 is another fragmentary view of the preferred embodiment of the apparatus of the present invention.
Figure 3:
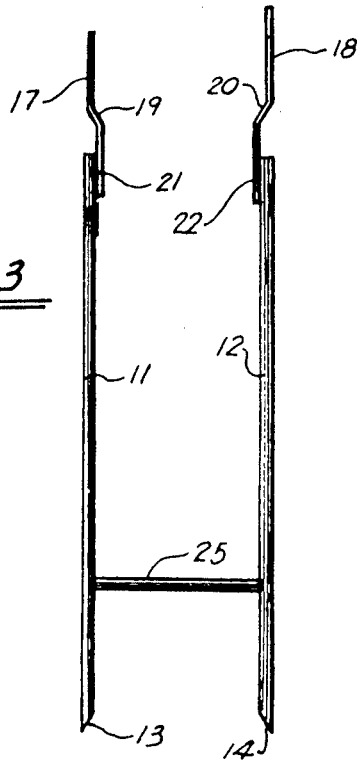
FIG. 3 is an elevational view of the preferred embodiment of the apparatus of the present invention.
Figure 4:
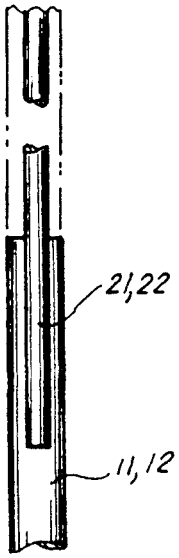
FIG. 4 is a fragmentary view of the preferred embodiment of the apparatus of the present invention.
Figure 2:
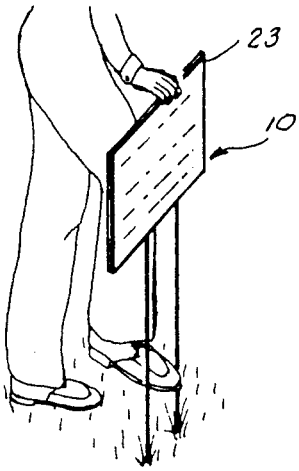
FIG. 2 is a perspective view of the preferred embodiment of the apparatus of the present invention illustrating installation.

Sign holder 10 includes a pair of longitudinally extending post members 11, 12 each of which is of a first larger diameter of for example one quarter to one half inch ($\frac{1}{4}$–$\frac{1}{2}$") in diameter. Cross bar 25 is affixed (preferably by welding) to posts 11, 12 at its ends as shown in FIGS. 1,3 and 5. The posts 11, 12 provide lower end portions 13, 14 which are pointed for driving into the underlying earth. The upper end portions !5, 16 of the posts 11, 12 define an attachment end portion for affixing a pair of elongated wire pins 17, 18 thereto. Pins 17, 18 are preferably of unequal length so that the pin 17 extends approximately one half to one inch above the upper end of the pin 18. Each pin is preferably curved at least along part of its length, providing curved portions 19, 20.

A welded connection 21, 22 forms an interface respectively between each post 11, 12 and its respective pins 17, 18. The pins 19 provide a central axis which is offset with respect to the axis of its post 11, 12. The top 15, 16 of each post 11, 12 thus defines a stop for a corrugated sign 23 shown in phantom lines in FIG. 1. Corrugated sign 23 is a commercially available sign member that is usually rectangular, having a pair or flat, generally parallel planar outer surfaces upon which printed material is placed. Between the faces of the sign is a corrugation 23*c* that includes multiple longitudinally extending bores 23*b* into which the pins 17, 18 are placed upon assembly of the sign 23 and holder 10.

The pins 17, 18 are of a relatively small diameter (e.g. $\frac{1}{8}''$–$\frac{1}{4}''$) in relation to the diameter of posts 11, 12. The posts 11, 12 can have a diameter of two to four times the diameter of the pins 17, 18 if desired. In this manner, the pins can be made small enough to fit the bores 23*b* of corrugations 23*c* of the sign 23. The posts 11, 12 can be made much heavier and bulkier than pins 17, 18 so that they can withstand the loading which is applied when a user places his or her foot upon cross bar 25 in order to drive the pointed ends 13, 14 of the post 11, 12 into the underlying earth.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A support stake for holding a corrugated sign in an upright position, comprising:

a) a pair of spaced apart, longitudinally extending wire post members of a first diameter;

b) a transverse cross beam connecting the lower end portions of the pair of post members to define a step for driving the posts into the underlying soil foundation;

c) a pair of longitudinally extending wire pins connected respectively to the pair of post members at the outer surface thereof so that the posts and the pins are laterally offset and the top of each post acts as a stop for defining the penetration of the pins into the corrugated portion of the sign;

d) the posts having a diameter at least twice the diameter of the pins.

2. The apparatus of claim 1 wherein the pins are of unequal length.

3. The apparatus of claim 1 wherein one of the pins is curved, at least along a portion of its length.

4. The apparatus of claim 1 wherein the pins are of a length of between about $\frac{1}{2}$ and $\frac{1}{3}$ the length of the posts.

5. The apparatus of claim 1 wherein the bottom end portion of each wire pin overlaps the upper end portion of its post.

6. The apparatus of claim 1 wherein the pins are welded to the posts.

7. The apparatus of claim 1 wherein the pins are wire pins having a diameter of between one eighth inches and one quarter inches.

8. The apparatus of claim 1 wherein each pin has a curved portion along a portion of its length.

* * * * *